US007390234B2

(12) United States Patent
Peach

(10) Patent No.: US 7,390,234 B2
(45) Date of Patent: Jun. 24, 2008

(54) SECTIONALIZED BOARD FOR WATER SPORTS

(76) Inventor: Brett Myndon Peach, 525 Pretoria Road, Fairleads, Benoni, 1501 Gauteng, Johannesburg (ZA)

( * ) Notice: Subject to any disclaimer, the term of this patent is extended or adjusted under 35 U.S.C. 154(b) by 45 days.

(21) Appl. No.: 10/554,882

(22) PCT Filed: Apr. 29, 2004

(86) PCT No.: PCT/IB2004/001312

§ 371 (c)(1),
(2), (4) Date: Oct. 16, 2006

(87) PCT Pub. No.: WO2004/096634

PCT Pub. Date: Nov. 11, 2004

(65) Prior Publication Data

US 2007/0054574 A1 Mar. 8, 2007

(30) Foreign Application Priority Data

Apr. 30, 2003 (ZA) ..... 2003/3360

(51) Int. Cl.
*B63B 35/79* (2006.01)
*B63B 7/04* (2006.01)

(52) U.S. Cl. ..... 441/74; 114/352

(58) Field of Classification Search ..... 114/39.12, 114/39.14, 77 R, 77 A, 352, 353; 441/65, 441/68, 73, 74, 79
See application file for complete search history.

(56) References Cited

U.S. PATENT DOCUMENTS 3,287,754 A 11/1966 Price et al.
3,409,920 A 11/1968 Brownley
3,996,868 A * 12/1976 Schagen ..... 114/39.14
4,586,451 A 5/1986 Mori ..... 114/219
4,719,952 A 1/1988 Geronimo ..... 150/52 R
4,807,549 A 2/1989 Rhodes et al. ..... 114/39.2
5,174,220 A 12/1992 Skedeleski et al. ..... 114/219
5,209,384 A 5/1993 Anderson ..... 224/209
5,476,403 A * 12/1995 Hsia ..... 441/74
5,558,552 A 9/1996 Namur ..... 441/75
7,121,909 B1 * 10/2006 Meyerhoffer ..... 441/74

FOREIGN PATENT DOCUMENTS

EP 52783 A1 * 6/1982
GB 1560011 1/1980
GB 1560011 A * 1/1980
WO WO 92011181 A1 * 7/1992

* cited by examiner

*Primary Examiner*—Ajay Vasudeva
(74) *Attorney, Agent, or Firm*—Dorsey & Whitney LLP

(57) ABSTRACT

The invention relates to a buoyant board (10) for water sports. The board includes a vertically flattened elongated body (12). The body has a lower face (14) for contact with water, and an upper face (16) for supporting a person, the lower face and the upper face meeting along a peripheral edge (18) of the body. The body is constituted by a pair of end parts (20, 22) and at least one intermediate part (24, 26) which is located between the end parts. The parts are arranged in series in abutment, and are separable such that each intermediate part is removable and optionally replaceable, to permit adjustment of the length of the body and to facilitate transport of the board when the various parts are separated. The invention extends to a backpack (110) for receiving the board, and to a kit comprising, in combination, the backpack and the board.

11 Claims, 9 Drawing Sheets

SECTIONALIZED BOARD FOR WATER SPORTS

THIS INVENTION relates to water sports. It more particularly relates to a buoyant board for water sports, to a backpack for receiving said board, and to a kit including the board in combination with the backpack.

It is expected that the invention will particularly advantageously be applicable to boards such as wakeboards, kiteboards, and also to other boards such as surfboards used in water sports, and such applications should particularly be borne in mind for purposes of this specification.

In accordance with one aspect of the invention, there is provided a buoyant board for water sports, which board includes a vertically flattened elongated body having a lower face for contact with water, and an upper face for supporting a person, the lower face and the upper face meeting along a peripheral edge of the body, the body being constituted by a pair of end parts and at least one intermediate part located between the end parts, the parts being arranged in series in abutment, and being separable such that each intermediate part is removable and optionally replaceable to permit adjustment of the length of the body and to facilitate transport of the board when the various parts are separated.

Typically, in operation, when an intermediate part is used, the board will include a single intermediate part only. The board may, however, be provided with a range of interchangeable intermediate parts, for use separately or together in combinations thereof, each intermediate part having a length which is different from that of any other intermediate part. Thus, if desired, more than one intermediate part may be used simultaneously.

The board may include a plurality of connection formations connecting together the parts of the body. While the connection formations can in principle connect the parts of the body together frictionally, this is not preferred, as the parts can in this case work loose from one another. Accordingly, the connection formations may include securing formations for preventing separation of the parts of the body, by locking the parts to one another.

The abutments between adjacent parts of the body may have zig-zag or wave-form profiles, each part, at each abutment, having an abutment face defining a plurality of crests alternating with a plurality of valleys, when seen in plan view. In this case, each abutment face of each part may be provided both with a plurality of transverse rods and with a plurality of transverse slots, the rods alternating with the slots across the width of the board, the rods being provided adjacent the floors of the valleys and the slots being provided in the peaks of the crests, the rods of each abutment face being received in the slots of the associated opposed abutment face, each rod and the associated slot providing a connection formation connecting the abutting parts together, the slot opening outwardly in the longitudinal direction of the board, to permit withdrawal of the rod from the slot in said longitudinal direction.

A clamp may be located in at least one of the slots in each part, each clamp being fast with the part of the body in which the slot is provided, a locking mechanism being associated with each clamp and locking the associated clamp so that each rod received in a slot provided with a clamp is held captive and clamped in said slot, the clamps and locking mechanisms providing said securing formations and each securing formation forming part of an associated connection formation, the connection formations connecting together the parts of the body.

Each locking mechanism may comprise an over-centre cam mechanism.

The board may include an impact guard extending at least partially along the peripheral edge of the body, protecting the peripheral edge of the body against impact damage and protecting a user against injury caused by impact with the peripheral edge of the body. The impact guard may be in the form of a shock- and impact-absorbing flexible strip extending along the entire peripheral edge of the body. The flexible strip may be divided into a plurality of parts respectively fast with the peripheral edges of the respective parts of the body.

The board may include seals in each abutment between adjacent parts of the body for sealing the abutment between said parts.

The board may include at least one attachment formation on at least one of the end parts of the board, for releasably attaching at least one fin or skeg to the lower face of said end part of the board. Advantageously, the board may include attachment formations on each of the end parts of the board, to provide for use of the board as a bi-directional board. Typically, each of the end parts will include attachment formations for attaching a plurality of spaced fins or skegs, laterally spaced from each—or one another, thereto. Naturally, if desired, the board may include a plurality of fins or skegs attached, permanently or releasably, to the lower faces of one or both of the end parts of the body.

The board may include at least one anchoring formation on the upper face of the body for anchoring at least one foot strap to the upper face of the body. Naturally, if desired, the board may include one or more foot straps anchored to the anchoring formations.

In accordance with another aspect of the invention there is provided a backpack for receiving a board as hereinbefore described, the backpack having a flexible wall defining a closeable primary compartment which is sub-divided into a plurality of sub-compartments by at least one divider partitioning the primary compartment and fast with the wall, the respective sub-compartments being for receiving parts of the board, and the backpack also including a pair of shoulder straps fast with the wall for carrying the backpack.

The backpack may include padding between sub-compartments for protecting the parts of the board in the sub-compartments against damage arising from rough handling of the backpack. The backpack may also include at least one secondary closeable compartment for receiving additional equipment associated with the board. The backpack may further include securing formations on the exterior of the wall for securing equipment associated with the board to the exterior of the backpack. The backpack may yet further include a waist strap fast with the wall, for strapping the backpack to the waist of a user.

In accordance with a further aspect of the invention there is provided a kit comprising, in combination, a backpack as hereinbefore described and a buoyant board for water sports, the board including a vertically flattened elongated body having a lower face for contact with water, and an upper face for supporting a person, the lower face and the upper face meeting along a peripheral edge of the body, the body being constituted by a plurality parts arranged in series in abutment, the parts being separable to permit transport of the board when the various parts are separated, with the parts of the board being located in the sub-compartments of the backpack.

The board may be a board as hereinbefore described, in which case each intermediate board part may have a length which is different from that of any other intermediate board part.

In accordance with a yet further aspect of the invention there is provided a buoyant board for water sports, which board includes a vertically flattened elongated body having a lower face for contact with water, and an upper face for supporting a person, the lower face and the upper face meeting along a peripheral edge of the body, the board being characterized in that it also includes an impact guard secured to the body and extending at least partially along its peripheral edge, for protecting the peripheral edge of the board against impact damage and for protecting a user against injury upon impact with the peripheral edge of the board.

The impact guard may be in the form of a shock- and impact-absorbing flexible strip extending along the entire peripheral edge of the body, being continuously fast with said peripheral edge. The impact guard may be adhesively secured to the peripheral edge of the body. The body may have a thickness which tapers towards the peripheral edge, the impact guard being provided with a recess for receiving said peripheral edge, so that the peripheral edge nests in the impact guard. The impact guard may be of a resiliently flexible polymeric material.

The invention is now described, by way of example, with reference to the accompanying diagrammatic drawings.

Figure 1:
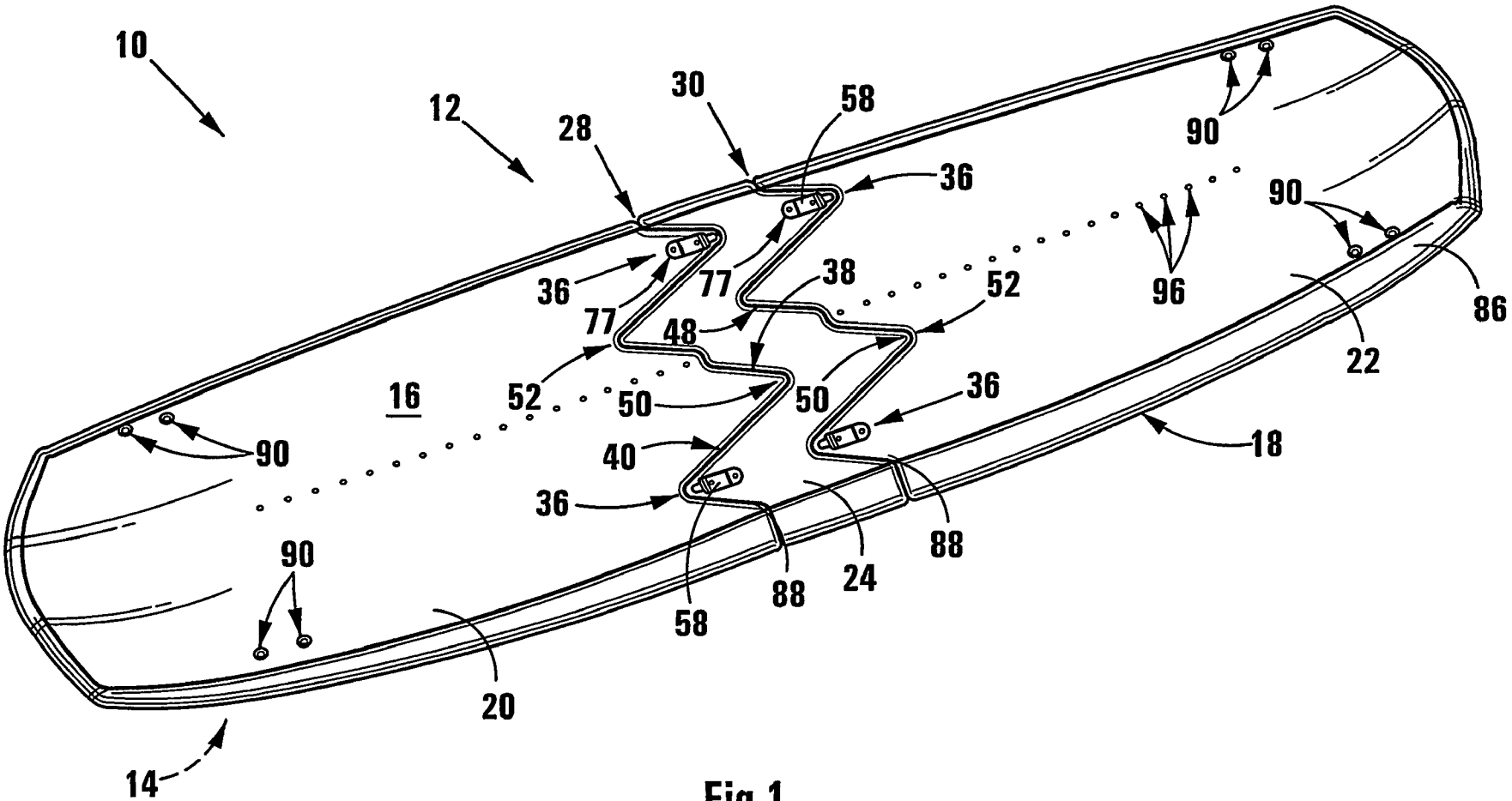
FIG. 1 shows a three-dimensional view of a buoyant board in accordance with the invention, the board including one intermediate part.

With reference to FIGS. 1-4 of the drawings, a buoyant board for supporting a person in water sports is generally indicated by reference numeral 10. In the embodiment described and illustrated, the board 10 is in the form of a kiteboard. Naturally, the board 10 can be any other buoyant board, such as a surfboard, a wakeboard, or the like, used for supporting a person in water sports.

The board 10 includes a vertically flattened elongated body, generally indicated by reference numeral 12, having a lower face 14 for contact with water, and an upper face 16 for supporting a person, the two faces 14, 16 meeting along a peripheral edge 18 of the body 12.

Figure 2:
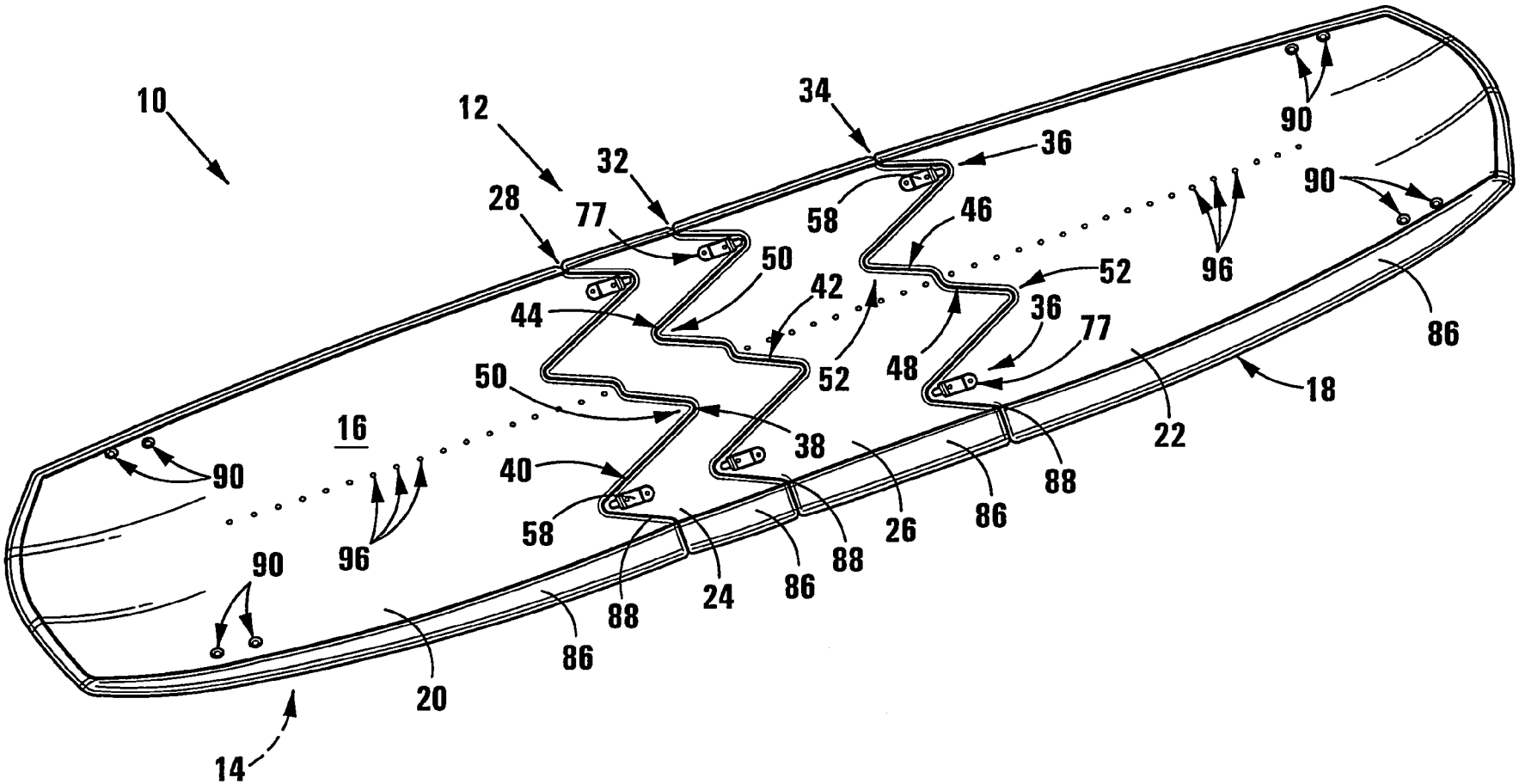
FIG. 2 shows a three-dimensional view of the board in accordance with the invention, the board including two intermediate parts.

The body 12 of the board 10, as illustrated in FIG. 1, is constituted by two end parts respectively designated 20, 22 between which is locked a replaceably removable intermediate part 24. In FIG. 2, the body 12 includes two intermediate parts respectively designated 24, 26, together forming a series of intermediate parts, the part 26 being longer than the part 24, which is identical to the part 24 of FIG. 1. The various parts 20, 22, 24 and/or 26, as the case may be, are arranged in series in abutment and are separable, to permit adjustment of the length of the body 12, and to facilitate transport of the board 10 when the various parts 20, 22, 24 and/or 26 are separated. Naturally, the intermediate parts 24, 26 are interchangeable in the three-part board of FIG. 1 to provide for enhanced adjustment of the length of the body 12. Although not shown as such, it will be appreciated that the body 10 need not necessarily include either one of the intermediate parts 24, 26, but can merely be constituted by the two end parts 20, 22, when an even shorter board is required.

In some embodiments (not shown), the series of intermediate parts can be constituted by more than two parts, each of said parts then being of a different length.

In the embodiments described and illustrated, the board 10 is a bi-directional board, so that operatively outer ends of the end parts 20, 22 of the body 12 are more or less identical, each of them, when seen in side elevation (FIG. 3), being curved operatively upwardly towards their outer tips and tapering longitudinally in thickness. When seen in plan view, the body 12 also tapers in width towards its ends, the ends being convexly profiled. In other embodiments, the board 10 can be a one-directional board, so that the aforementioned does not apply.

With reference to FIG. 1, the end part 20 and the intermediate part 24 abut along an abutment generally indicated by reference numeral 28, and the end part 22 and the intermediate part 24 abut along an abutment generally indicated by reference numeral 30.

Referring now to FIG. 2, in which the body 12 includes two intermediate parts 24, 26, the abutment at 28 is as shown in FIG. 1, while the intermediate parts 24, 26 abut along an abutment generally indicated by reference numeral 32, and the end part 22 and the intermediate part 26 abut along an abutment generally indicated by reference numeral 34. As can be seen in the drawings, the respective abutments 28, 30, 32, 34, when seen in plan view, have generally zig-zag or wave-form profiles. On account of these zig-zag or wave-form profiles of the abutments 28, 30, 32, 34 (as opposed to merely straight profiles), increased areas of contact between abutting faces (described hereinafter) of the parts 20, 22, 24, 26 are provided, and this can enhance the strength of the board 10 at the abutments 28, 30, 32, 34.

For ease of reference, the board 10 will hereinafter be described with reference to the embodiment including two intermediate parts 24, 26, as illustrated in FIG. 2, unless otherwise specified.

The board 10 further includes connection formations, generally indicated by reference numeral 36, for connecting the respective parts 20, 22, 24, 26 of the body 12 together.

The abutment 28 is formed between an abutment face 38 of the end part 20 and an opposed abutment face 40 of the intermediate part 24. The abutment 30 is formed between an abutment face 42 of the intermediate part 24 and an abutment face 48 of the end part 22. The abutment 32 is formed between the abutment face 42 of the intermediate part 24 and an abutment face 44 of the intermediate part 26. The abutment 34 is formed between an abutment face 46 of the intermediate part 26 and the abutment face 48 of the end part 22.

Because, as mentioned above, each of the abutment faces 38, 40, 42, 44, 46, 48 has, when seen in plan view, a zig-zag or wave-form profile, it defines a plurality of alternating crests 50 and valleys 52.

The connection formations 36 include rods 54 and slots 56 provided at each abutment face 38, 40, 42, 44, 46, 48 and alternating across the width of the board 12, the rods 54 being provided close to bottoms of the valleys 52 of the respective abutment faces 38, 40, 42, 44, 46, 48, and the slots 56 being provided in the peaks of the crests 50 of the respective abutment faces, 38, 40, 42, 44, 46, 48. The rods 54 of the abutment faces 38, 40, 42, 44, 46, 48 are received in the slots 56 of their associated abutment faces 38, 40, 32, 44, 46, 48. Each rod 50 and its associated slot 56 thus form a connection formation connecting the abutting parts 20, 22, 24, 26 of the body 12 together. Each rod 54 is withdrawable, in the longitudinal direction of the board, from its associated slot 56, when the clamps 58 are unlocked, as described hereunder.

Figure 6:
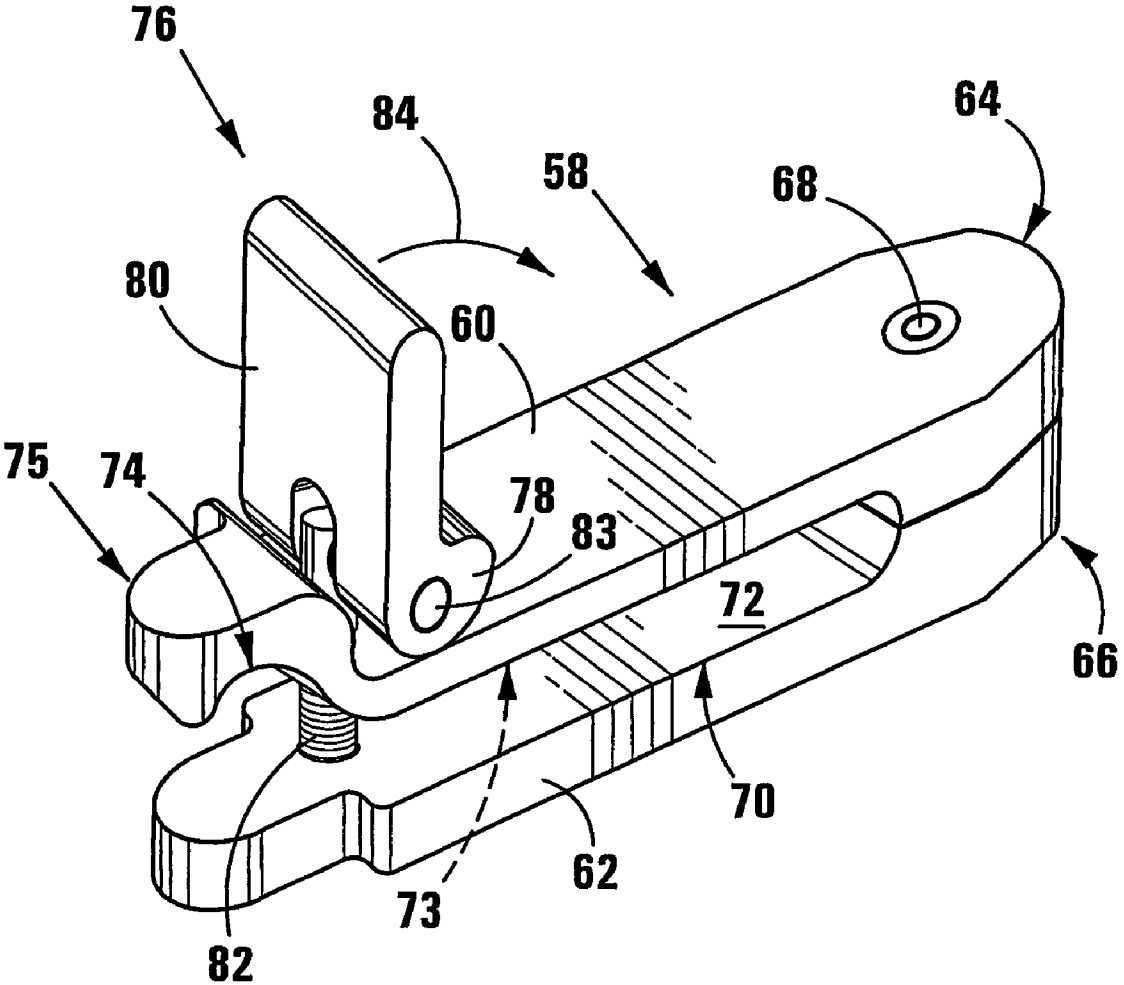
FIG. 6 shows a three-dimensional view of a clamp forming part of the board in accordance with the invention.

Some of the connection formations 36 further include securing formations for preventing separation of the parts 20, 22, 24, 26 of the body 12 (see FIG. 6 in particular). Each securing formation includes a clamp 58 associated with one of the slots 56 of each of the abutment faces 38, 40, 42, 44, 46, 48, and a locking mechanism in the form of an over-centre cam mechanism 76 associated with each clamp 58 and locking the associated clamp 58, so that each rod 54 received in a slot 56 provided with a securing formation is held captive and clamped in the slot 56. As can be seen, the clamps 58 are associated with slots 56 in the respective parts 20, 22, 24, 26 so that adjacent pairs of parts 20, 22, 24, 26 are locked together by two clamps 58, the two clamps 58 respectively being provided on two of the respective adjacent parts 20, 22, 24 or 26, as the case may be. The clamps 58 are fast with their associated parts 20, 22, 24 or 26, as the case may be.

Each clamp 58 includes two elongated opposed limbs 60, 62 (FIG. 6). Operatively connected ends 64, 66 of the limbs 60, 62 have protrusions which protrude from their opposed inner faces 72, 73, the limbs 60, 62 being connected together by a screw 68 located in an aperture through said ends 64, 66, so that the inner faces 72, 73 are spaced from each other, and an elongated U-shaped slot 70 is defined between therebetween. The opposite end 75 of the limb 60 curves upwardly, with the inner face 73 of the end 75 of the limb 60 being concavely curved at 74 so that a rod-receiving space is defined between that part of the inner face 73 of the limb 60 and the opposed part of the inner face 72 of the limb 62.

Each over-centre cam mechanism 76 includes a cam 78 integrally formed with a lever 80 for rotating the cam 78. To this end, the parts 20, 22, 24, 26 are provided with apertures 77 extending through their upper faces 16 into the slots 56, through which apertures 77 the levers 88 project upwardly when the clamps 58 are unlocked. Each over-centre cam mechanism 76 also includes a threaded pin 82 by which it is secured to its associated clamp 58, each pin 82 extending respectively along a threaded socket therefor in each of the limbs 60, 62 of its associated clamp 58. Each over-centre cam mechanism 76 is spaced longitudinally inwardly from its associated rod-receiving space 74. Each cam 78, in turn, is secured to its associated pin 82 by means of an axle 83 extending through the cam 78 and through an aperture adjacent the upper end of its associated pin 82, each cam 78 being rotatable about the axis of the its associated axle 83, which axis is horizontal and transverse to the limbs 60, 62. The pins 82 are threaded so that, when the rods 54, the clamps 58, or the cams 78 become worn, the distance between the opposed inner faces 72, 73, where the pins 82 extend through the limbs 62, 60, can be adjusted, to accommodate said wear.

The parts 20, 22, 24, 26 are of fibre-reinforced plastics construction. Likewise, the securing formations are primarily of such fibrous construction. In other embodiments not illustrated or described, the parts 20, 22, 24, 26 and the securing formations can be constructed of other suitable materials such as wood and/or suitable corrosion-resistant metals.

In use, when the respective abutment faces 38, 40, 42, 44, 46, 48 abut one another, and the respective rods 54 are received in their associated slots 56, the levers 80 of the respective over-centre cam mechanisms 76 are displaced in the direction indicated by arrow 84 (FIG. 6) thereby displacing free ends of the respective limbs 60, 62 of each of the clamps 58 towards each other, so that the rods 54 are held captive and clamped in their associated rod-receiving spaces at 74 and, accordingly, are clamped in their associated slots 56, thereby securely locking the respective adjacent parts 20, 22, 24, 26 of the body 12 together.

The board 10 further includes an impact guard 86 in the form of a resiliently flexible rubber strip continuously fast with an extending along the entire peripheral edge 18 of the body 12. As will be appreciated, the impact guard 86, as is the case with the body 12, is constituted by a plurality of parts respectively continuously fast with the peripheral edge(s) 18 of each of the respective parts 20, 22, 24, 26. The impact guard 86 protects the peripheral edge 18 of the body 12 against impact damage and also serves to protect a user against injury caused by impact with the peripheral edge 18 of the body 12. In the embodiment described and illustrated, the impact guard 86 is adhesively affixed to the peripheral edge 18 of the body 12. The impact guard 86 thus provides the peripheral edge 18 of the board 10, and it is also indicated as such in the drawings.

Figure 5:
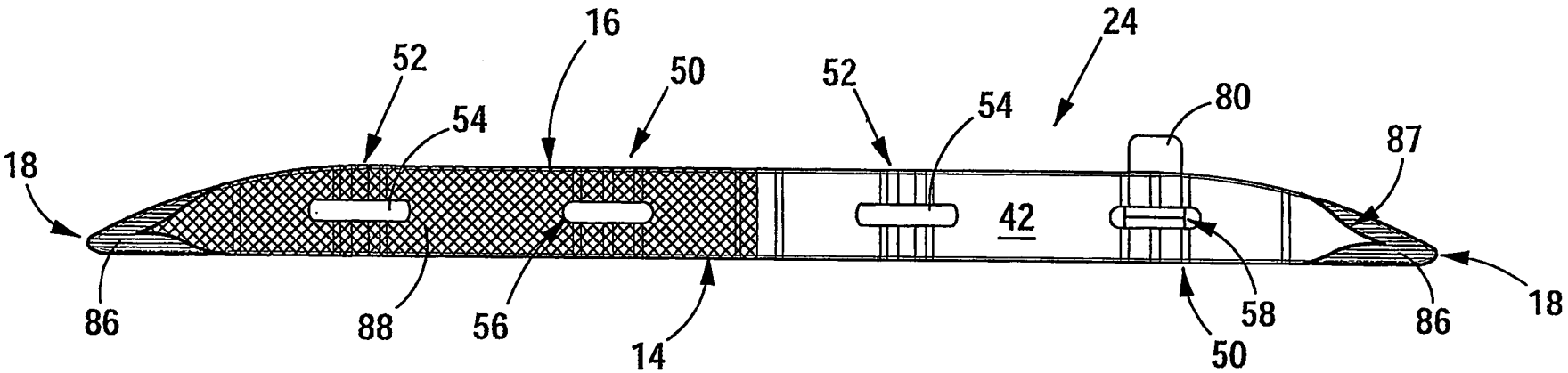
FIG. 5 shows an end elevation, as seen in the direction of arrow V in FIG. 4, of the intermediate part of the board shown in FIG. 1.

As can be seen in FIG. 5, the body 12 has a thickness which tapers towards the peripheral edge 18 thereof. The impact guard 86, is provided with a recess 87 which has a profile complemental to that of the peripheral edge of each part 20, 22, 24, 26, the peripheral edge of each said part being nested in the recess 87. The particular profile of the peripheral edge of the body parts and of the recess 87 thus provides (as opposed to merely a single flat planar area of contact) a greater area of contact therebetween, for enhanced adhesive securement strength.

The board 10 further includes seals .88 in the abutments 28, 30, 32, 34 between adjacent parts 20, 22, 24, 26 for sealing the abutments 28, 30, 32, 34. The seals 88 are in the form of rubber strips adhesively fast with the respective abutment faces 38, 40, 42, 44, 46, 48, each seal 88 extending over the entire depth and along half of the length of its associated abutment face 38, 40, 42, 44, 46, 48, with the seals 88 of opposed abutment faces 38, 40, 42, 44, 46, 48 being positioned on their respective abutment faces 38, 40, 42, 44, 46, 48 so that they together extend along and seal the entire length of each abutment 28, 30, 32, 34.

Figure 3:
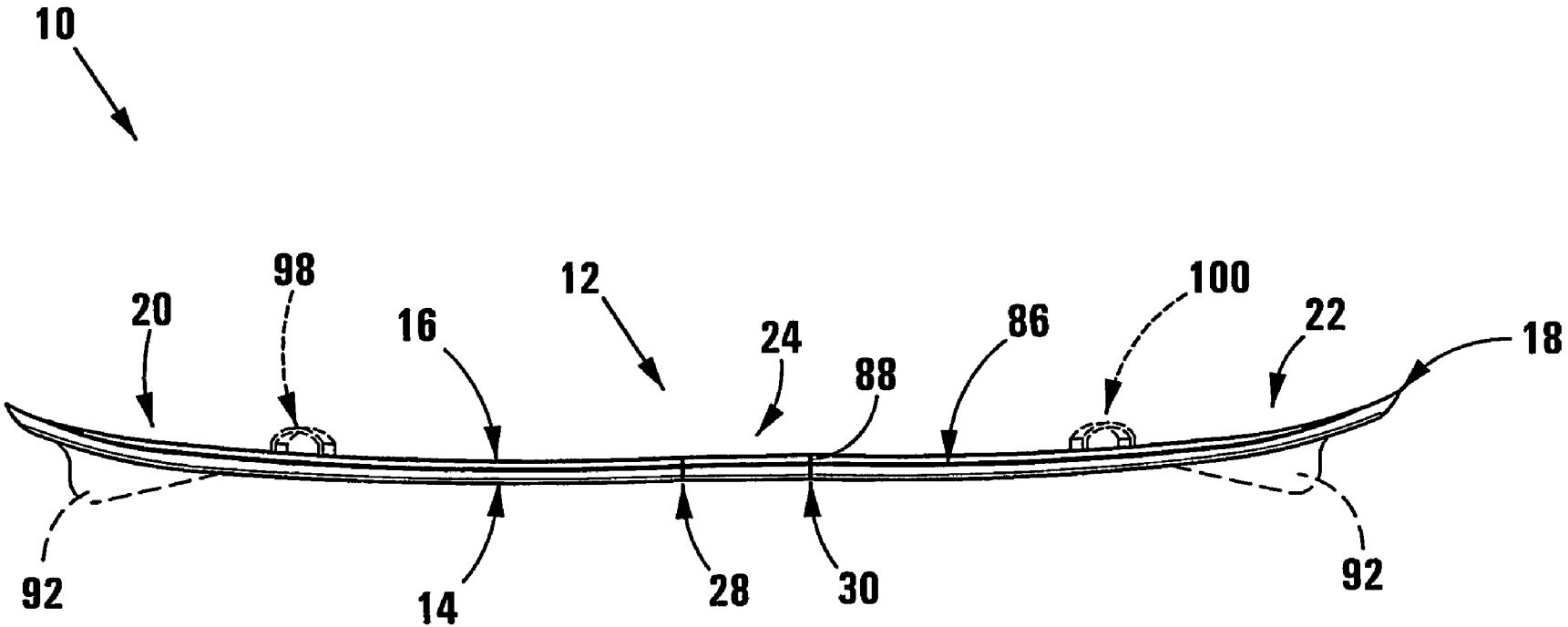
FIG. 3 shows a side elevation of the board shown in FIG. 1.
Figure 4:
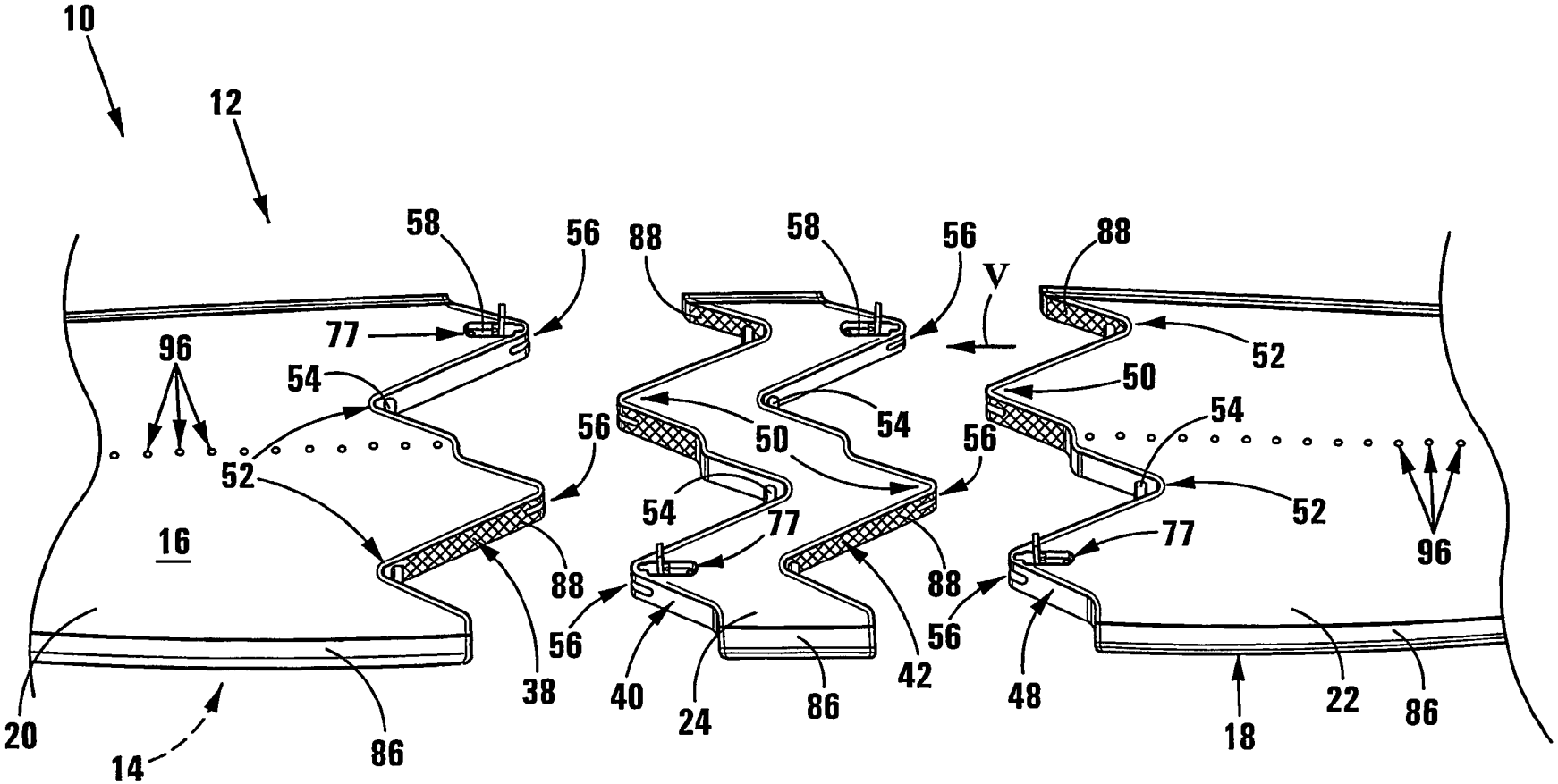
FIG. 4 shows a partial three-dimensional view of the board shown in FIG. 1, the various parts of the board being separated.

The board 10 further includes attachment formations 90 for attaching skegs or fins 92 (FIG. 3) to the lower face 14 of the body 12. In FIG. 3 the board 10 includes these skegs or fins 92. The attachment formations 90 are in the form of pairs of downwardly opening apertures or passages 90 for receiving bolts or screws (not shown) by means of which the fins or skegs 92 are attached to the body 12. In this embodiment, each of the end parts 20, 22 includes two pairs of apertures 90, the apertures 90 of each pair being longitudinally spaced along the board 10, with the respective pairs being laterally spaced from each other across the width of the board 10 and located adjacent the free ends of the end parts 20, 22. Each of the end parts 20, 22 thus provides for securement of two laterally spaced skegs or fins 92 to their respective lower faces 14.

The board 10 further includes anchoring formations for anchoring one or more foot straps 98, 100 (shown schematically in broken lines in FIG. 3) to the upper face 16 of the body 12. The anchoring formations are in the form of a series of longitudinally spaced upwardly opening apertures or passages 96 for receiving screws or bolts (not shown) by means of which the foot straps 98, 100 are secured to the board 10.

Figure 7:
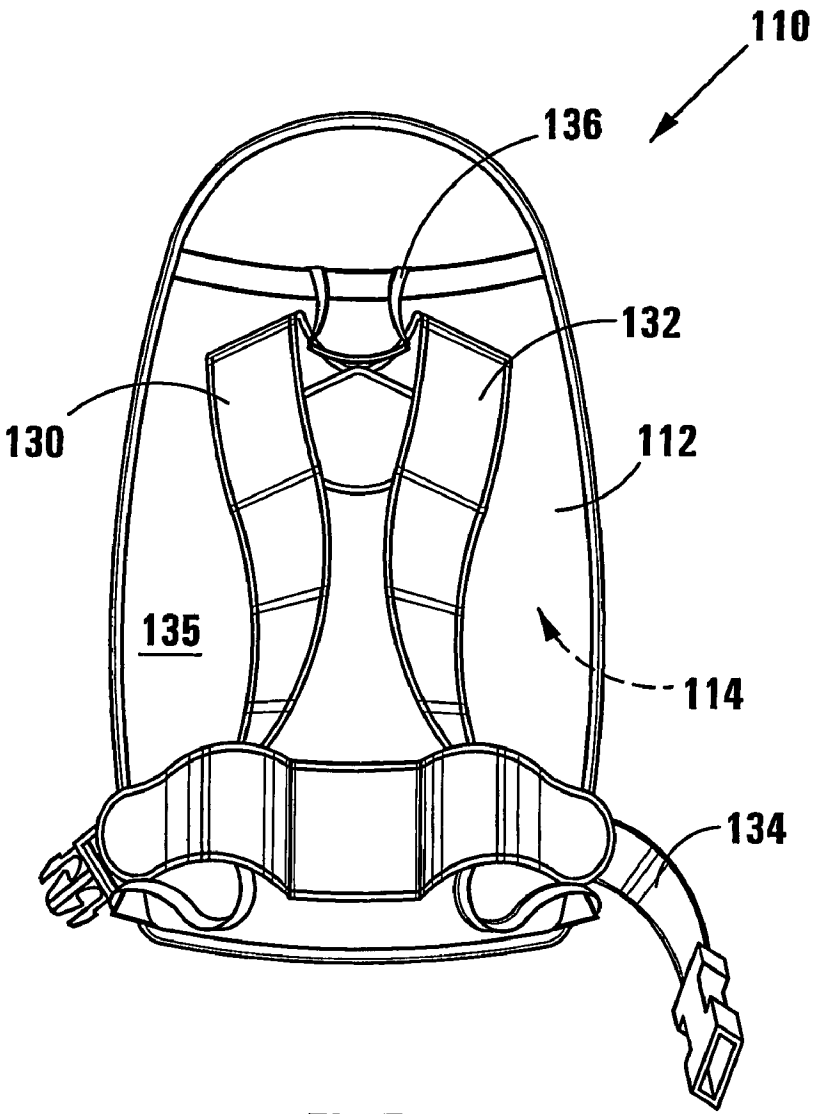
FIG. 7 shows a front elevation of a backpack in accordance with the invention.
Figure 8:
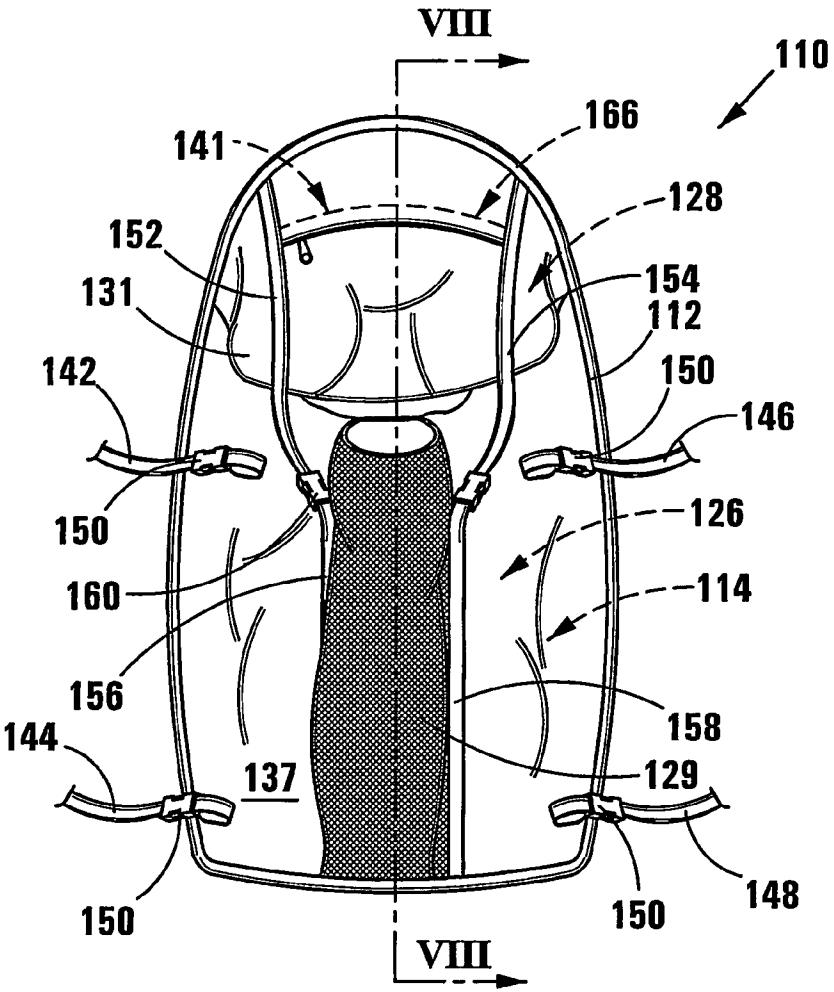
FIG. 8 shows a rear elevation of the backpack shown in FIG. 7.
Figure 9:
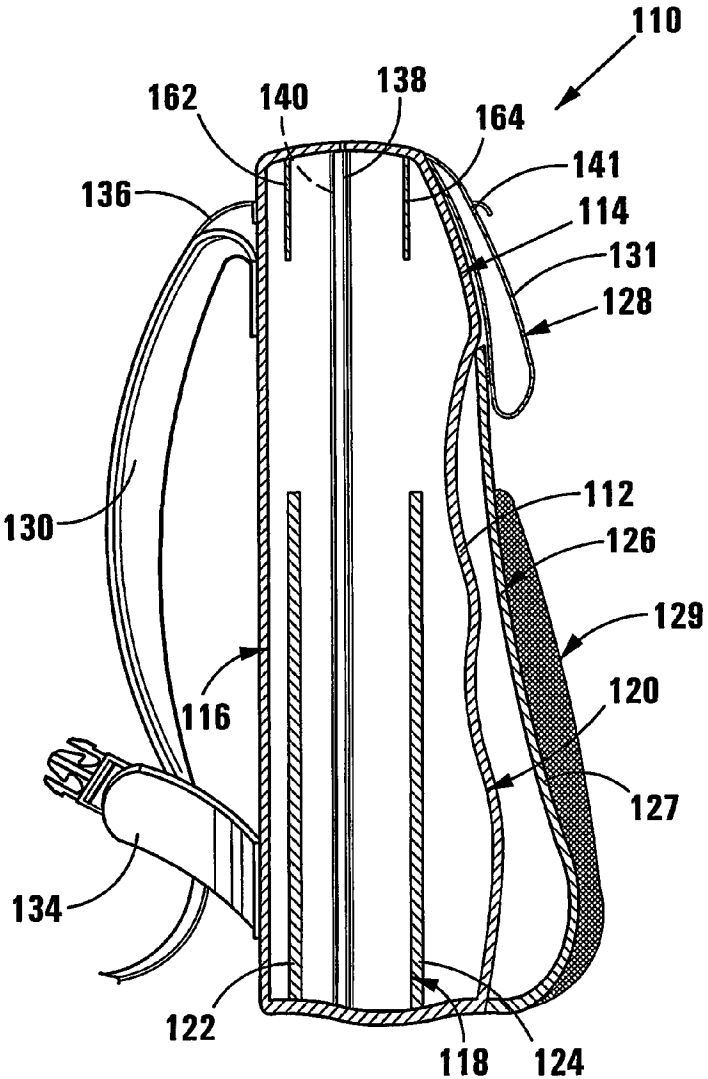
FIG. 9 shows a sectional side elevation, taken at VIII-VIII in FIG. 8, of the backpack in accordance with the invention.

Referring now to FIGS. 7-9, a backpack in accordance with the invention is generally indicated by reference numeral 110. The backpack 110 is intended for receiving the board 10 when its parts 20, 22, 24, 26 are separated. The backpack 110 and the board 10, in combination, constitute a kit in accordance with the invention.

The backpack 110 includes a flexible (woven textile) wall 112 defining a closable primary compartment 114, the primary compartment 114 being sub-divided into sub-compartments 116, 118, 120 by two divider partitions 122, 124 fast with the flexible wall 112. The backpack 110 further includes an open-topped secondary compartment 126 defined by the flexible wall 112 and a flexible divider wall 127 fast with the flexible wall 112. The backpack 110 also includes a primary pocket 128 defined by a further flexible wall 131 fast, at an upper edge thereof, with an upper edge of the flexible wall 112 and serving as a flap overhanging the upper part of a rear face 137 of the backpack 110, the flap closing the secondary compartment 126. The backpack 110 yet further includes a secondary pocket 129, which has an open top and is constructed of a mesh material, the secondary pocket 129 being fast with the flexible wall 112 on the rear face 137 of the backpack 110.

The backpack further includes a pair of shoulder straps 130, 132 and a waist strap 134, all of which are fast with the flexible wall 112 and are located on a front face 135 of the backpack 110. A carrier handle 136 is provided on the front face 135 of the backpack 110. The construction of the shoulder straps 130, 132, the waist belt 134, and the handle 136, and their securement to the flexible wall 112 are in accordance with conventional backpack construction and, therefore, it are not described in any further detail.

The primary compartment 114 has an open top which is closed by a slide fastener 140 extending transversely across the top of the backpack 110 and along a seam 138 of the flexible wall 112. Likewise, the primary pocket 128 has an open top which is closeable by a slide fastener 141.

The rear face 137 of the backpack 110 is provided with strap arrangements each including two individual straps 142, 144, 146, 148, as the case may be, provided with the respective parts of clip arrangements 150 for securing the two parts of each respective strap arrangement together.

The backpack 110 further includes straps 152, 154 fast with the flexible wall 131 and extending downwardly therefrom, the straps 152, 154 respectively being associated with straps 156, 158 fast with a lower part of the rear face 137 of the backpack 110. Ends of the respective straps 152, 154, 156, 158 are respectively provided with the respective parts of clip arrangements 160 for closing the secondary compartment 126.

In use, the parts 20, 22, 24, 26, of the body 12 of the board 10 (FIG. 2) are received in the primary compartment 114. More specifically, one of the end parts 20, 22 is received in the sub-compartment 116 and the other one of the end parts 20, 22 is received in the sub-compartment 120, with the intermediate parts 24, 26 being received in the sub-compartment 118. To this end, the divider partitions 122, 124 are padded to protect the parts 20, 22, 24, 26 of the body 12 in the subcompartments 116, 118, 120 against damage arising from rough handling of the backpack 110. Also, the backpack 110 includes two elastic retainers 162, 164 located in the primary compartment 114 and fast with the top of the flexible wall 112, for retaining upper ends of the respective end parts 20, 22, in position when the end parts 20, 22 are received in the compartments 116, 120. The retainers are hooked or clipped over said ends of the parts 20, 22 to retain the upper ends of the parts 20, 22 in position.

Equipment associated with the board 10, typically a kite or the like (not shown), is, in use, received in the secondary compartment 126. Further equipment or the like associated with the board 10 or with a user of the board 10 is, in use, received in the primary and secondary pockets 128, 129. The primary pocket 128 has an open top which is closable by means of said slide fastener 141. Due to the mesh-like construction of the secondary pocket 129, it is suited for receiving wet or damp items, such as a wet or damp bathing suit or towel (not shown). Yet further equipment (not shown) associated with the board 10 can be strapped to the exterior of the backpack 110 by means of the straps 142, 144, 146, 148.

In use, a user will typically transport the board 10 with its parts 20, 22, 24, 26 disconnected from one another, thereby facilitating handling and accommodation thereof in relatively confined spaces such as interiors of vehicles, or the like. When the parts 20, 22, 24, 26 are disconnected from one another, they can easily be fitted into the backpack 110 as above described. Once in the backpack 110, the board 10 can be handled and transported with ease.

Depending upon weather conditions at the point of use and depending on the skills of the user, the user will decide on the length of board 10 to be used, and will accordingly select a suitably sized intermediate part 24, 26, or may even decide to make use of both intermediate parts 24, 26, or may yet further decide to omit the intermediate parts 24, 26 altogether, and merely connect the end parts 20, 22 together as hereinbefore described. After connection and securing together of the parts, the board 10 can then be used in a conventional manner.

The invention as described and illustrated thus provides a buoyant board, for water sports, of which the length can easily be adjusted in accordance with the preferences of a particular user. Furthermore, the separability of the board, in combination with the backpack, facilitates easy handling and transportation of the board.

The invention claimed is:

1. A buoyant board for water sports, which board comprises a vertically flattened elongated body having a lower face for contact with water, and an upper face for supporting a person, the lower face and the upper face meeting along a peripheral edge of the body, the body being constituted by a pair of end parts and at least one intermediate part located between the end parts, the parts being arranged in series in abutment, and being separable such that each intermediate part is removable and optionally replaceable to permit adjustment of the length of the body and to facilitate transport of the board when the various parts are separated, the abutments between adjacent parts of the body having zig-zag or waveform profiles, each part, at each abutment, having an abutment face defining a plurality of crests alternating with a plurality of valleys, when seen in plan view, each abutment face of each part being provided both with a plurality of transverse rods and with a plurality of tranverse slots, the rods alternating with the slots across the width of the board, the rods being provided adjacent the floors of the valleys and the slots being provided in the peaks of the crests, the rods of each abutment face being received in the slots of the associated opposed abutment face, each rod and the associated slot providing a connection formation connecting the abutting parts together, the slots opening outwardly in the longitudinal direction of the board.

2. The buoyant board as claimed in claim 1, wherein the connection formations include securing formations for preventing separation of the parts of the body.

3. The board as claimed in claim 2, wherein a clamp is located in at least one of the slots in each part, each clamp being fast with the part of the body in which the slot is provided, a locking mechanism being associated with each clamp and locking the associated clamp so that each rod received in a slot provided with a clamp is help captive and clamped in said slot, the clamps and locking mechanisms providing said securing formations and each securing formation forming part of an associated connection formation, the connection formations connecting together the parts of the body.

4. The board as claimed in claim 3, wherein each locking mechanism comprises an over-centre cam mechanism.

5. The board as claimed in claim 1, further comprising an impact guard extending at least partially along the peripheral edge of the body, protecting the peripheral edge of the body against impact damage and protecting a user against injury caused by impact with the peripheral edge of the body.

6. The board as claimed in claim 5, wherein the impact guard is in the form of a shock and impact-absorbing flexible strip extending along the entire peripheral edge of the body.

7. The board as claimed in claim 6, wherein the flexible strip is divided into a plurality of parts respectively fast with the peripheral edge of the respective parts of the body.

8. The board as claimed in claim 1, further comprising seals in each abutment between adjacent parts of the body for sealing the abutment between said parts.

9. The board as claimed in claim 1, further comprising at least one attachment formation on at least one of the end parts of the body, for releasably attaching at least one fin or skeg to the lower face of said body.

10. The board as claimed in claim 9, comprising a said attachment formation on each of the end parts of the body, to provide for use of the board as a bi-directional board.

11. The board as claimed in claim 1, further comprising at least one anchoring formation on the upper face of the body for anchoring at least one foot strap to the upper face of the body.

* * * * *